US011235923B2

(12) United States Patent
Polacek et al.

(10) Patent No.: US 11,235,923 B2
(45) Date of Patent: Feb. 1, 2022

(54) FLAT PANEL ABOVE-GROUND STORAGE TANK

(71) Applicant: JWF Industries, Inc., Johnstown, PA (US)

(72) Inventors: William C. Polacek, Johnstown, PA (US); Marc J. Speciale, Johnstown, PA (US); Randall Shank, Johnstown, PA (US)

(73) Assignee: JWF Industries, Inc., Johnstown, PA (US)

( * ) Notice: Subject to any disclaimer, the term of this patent is extended or adjusted under 35 U.S.C. 154(b) by 0 days.

(21) Appl. No.: 17/043,051

(22) PCT Filed: Mar. 29, 2019

(86) PCT No.: PCT/US2019/024850
§ 371 (c)(1),
(2) Date: Sep. 29, 2020

(87) PCT Pub. No.: WO2019/191596
PCT Pub. Date: Oct. 3, 2019

(65) Prior Publication Data

US 2021/0016962 A1 Jan. 21, 2021

Related U.S. Application Data

(60) Provisional application No. 62/649,909, filed on Mar. 29, 2018.

(51) Int. Cl.

| | |
|---|---|
| ***B65D 90/08*** | (2006.01) |
| ***B65D 90/20*** | (2006.01) |
| *B65D 90/04* | (2006.01) |

(52) U.S. Cl.
CPC ..... *B65D 90/205* (2013.01); *B65D 90/08* (2013.01); *B65D 90/046* (2013.01); *F17C 2201/0109* (2013.01)

(58) Field of Classification Search
CPC .... B65D 90/08; B65D 90/046; B65D 90/023; B65D 90/024; B65D 90/026; B65D 90/047; B65D 90/048; B65D 90/24; F17C 2201/0109; E04H 2007/225
See application file for complete search history.

(56) References Cited

U.S. PATENT DOCUMENTS

| | | | |
|---|---|---|---|
| 730,344 | A | 6/1903 | Clayton, Sr. |
| 1,416,849 | A | 5/1922 | Loop |
| 2,094,598 | A | 10/1937 | Day |
| 2,119,518 | A | 6/1938 | Boardman |
| 2,380,089 | A | 7/1945 | Ulm |
| 2,532,854 | A | 12/1950 | Plummer |

(Continued)

*Primary Examiner* — Stephen J Castellano
(74) *Attorney, Agent, or Firm* — The Webb Law Firm

(57) ABSTRACT

A fluid storage tank includes a plurality of end panels defining a plurality of curved wall sections and a plurality of side panels extending between and connecting the plurality of curved wall sections. The plurality of end panels and plurality of side panels define a perimeter wall. The fluid storage tank further includes a plurality of cable arms, each of the cable arms connected to a flange of at least one of the plurality of end panels or side panels, and at least one upper tension member having a first end connected to one of the plurality of cable arms and a second end connected to another of the plurality of cable arms.

19 Claims, 8 Drawing Sheets

(56) References Cited

U.S. PATENT DOCUMENTS

| | | | | |
|---|---|---|---|---|
| 2,533,041 | A | 12/1950 | Plummer | |
| 2,684,173 | A | 7/1954 | Schmitz | |
| 3,062,402 | A | 11/1962 | Farrell et al. | |
| 3,096,901 | A | 7/1963 | Arne | |
| 3,112,044 | A | 11/1963 | Larsen et al. | |
| 3,409,161 | A | 11/1968 | Arne | |
| 4,193,510 | A | 3/1980 | Weston | |
| 4,267,676 | A | 5/1981 | Marchaj | |
| 4,989,751 | A | 2/1991 | Gillett | |
| 5,222,618 | A | 6/1993 | Koch | |
| 5,462,193 | A | 10/1995 | Schoo | |
| 7,934,619 | B1 | 5/2011 | Robertson | |
| 8,365,937 | B2 | 2/2013 | Lovelace et al. | |
| 8,590,727 | B2 | 11/2013 | Dupuis et al. | |
| D728,731 | S | 5/2015 | Ellis | |
| 9,551,163 | B2 | 1/2017 | Perez | |
| 2009/0283522 | A1 | 11/2009 | Donaldson | |
| 2011/0138728 | A1 | 6/2011 | Kuznetsov | |
| 2011/0167828 | A1 | 7/2011 | McDermott et al. | |
| 2012/0152960 | A1 | 6/2012 | Toews et al. | |
| 2013/0020331 | A1 | 1/2013 | Davis et al. | |
| 2013/0087558 | A1 | 4/2013 | Bohley et al. | |
| 2013/0098906 | A1 | 4/2013 | Lovelace et al. | |
| 2013/0105475 | A1 | 5/2013 | Marshall | |
| 2013/0180996 | A1 | 7/2013 | Lee et al. | |
| 2013/0327776 | A1 | 12/2013 | Raybuck et al. | |
| 2014/0069932 | A1 | 3/2014 | Musso | |
| 2014/0197166 | A1 | 7/2014 | Raybuck et al. | |
| 2015/0021319 | A1* | 1/2015 | Avery | B65D 90/046 220/4.16 |
| 2015/0144624 | A1 | 5/2015 | Noles, Jr. et al. | |
| 2016/0152411 | A1 | 6/2016 | Corbeil | |
| 2017/0101260 | A1 | 4/2017 | Steinke | |

* cited by examiner

FLAT PANEL ABOVE-GROUND STORAGE TANK

CROSS-REFERENCE TO RELATED APPLICATIONS

The present application is the United States national phase of International Application No. PCT/US2019/024850 filed Mar. 29, 2019, and claims the benefit of U.S. Provisional Patent Application No. 62/649,909, filed on Mar. 29, 2018, the disclosures of which are hereby incorporated by reference in their entirety.

BACKGROUND OF THE INVENTION

Field of the Invention

The present invention relates generally to fluid storage tanks, also known as above-ground storage tanks ("ASTs"). More particularly, the present invention relates to fluid storage tanks having a stadium or obround shape. The present invention also relates to fluid storage tanks having tension members spanning the panels thereof.

Description of Related Art

Above-ground fluid storage tanks are well known in the art and are employed in a variety of industries. In oil and gas drilling applications, such storage tanks are used to hold well fracturing fluids as an alternative or additionally to smaller trailer tanks and/or skidded tanks. Often a very large amount of fracturing fluid is necessary for performing the fracturing operation. A well is ideally fractured in a single, uninterrupted procedure to avoid unnecessary expenses, such as equipment rental and labor costs incurred if the fracturing procedure is temporarily terminated to replenish fracturing fluid. As such, large storage tanks capable of holding sufficient fluid for one or more fracturing operations are desirable. Storage tanks of a necessary size may be too large to transport when fully assembled, so the tanks may be modularly constructed to facilitate transportation from jobsite to jobsite in a disassembled state. In order to prevent fluid from escaping at the joints between the modular sections of such storage tanks, a liner may be utilized.

Current storage tanks are often circular in shape to provide the strongest resistance to outward bowing of the tank walls due to the hydrostatic pressure of the fluid contained within the tanks. However, circular tanks may be impractical in applications where the terrain of the jobsite limits the size of the tank that can be used. In some circumstances, it may be preferable to provide an elongated tank having a different length than width to accommodate the topography of the jobsite. However, the design of tanks that deviate from a circular shape must consider the decreased resistance to hydrostatic pressure inherent in non-circular shapes. Additionally, increasing the height of the storage tanks to increase the holding capacity inherently increases the hydrostatic pressure of the fluid exerted on the tank walls. Thus, additional structural support may be necessary to provide tanks having sufficient holding strength.

An example of a tank design having structural reinforcement is described in U.S. Patent Application Publication No. 2011/0138/728 to McDermott et al. McDermott teaches an elongated tank having ties extending across the width of the tank to connect the tank walls opposite one another, thereby providing resistance against bowing of the tank walls. The ties of McDermott are connected to brackets secured to the inside of the tank walls. Another method of providing internal structural support to a storage tank described in U.S. Pat. No. 2,533,041 to Plummer utilizes inclined bracing connecting the walls of a rectangular tank to the floor. U.S. Pat. No. 7,934,619 to Robertson describes a waste water tank having multiple internal chambers separated by inner walls. Similar to McDermott, Robertson provides cables extending between the inner walls to provide bracing and support when the chambers are filled to different levels and, thus, exert uneven pressure on opposite sides of the inner walls.

The ties of McDermott, bracing of Plummer, and cables of Robertson are attached to inside walls of the tank such that a liner cannot be used. Other examples of storage tanks which are compatible with liners may utilize external bracing to reinforce the tank walls against hydrostatic pressure. One such design is described in U.S. Pat. No. 9,551,163 to Perez, which is directed to a modular liquid storage tank having external, triangular buttresses which transmit hydrostatic pressure exerted on the walls of the tank downwardly to a shoe.

SUMMARY OF THE INVENTION

In view of the foregoing, there exists a need for a fluid storage tank having a stadium or obround shape having straight side panels and semicircular ends. Further, there exists a need for a fluid storage tank spanned by tension members to resist hydrostatic pressure, without interfering with the tank liner.

Embodiments of the present invention are directed to a fluid storage tank including a plurality of end panels defining a plurality of curved wall sections and a plurality of side panels extending between and connecting the plurality of curved wall sections. The plurality of end panels and plurality of side panels define a perimeter wall. The fluid storage tank further includes a plurality of cable arms, each of the cable arms connected to a flange of at least one of the plurality of end panels or at least one of the plurality of side panels, and at least one upper tension member having a first end connected to one of the plurality of cable arms and a second end connected to another of the plurality of cable arms.

In some non-limiting embodiments, each cable arm includes a main arm, at least one tension member mounting bracket attached to one end of the main arm and configured to attach to one of the upper tension members, and a panel mounting bracket attached to an opposite end of the main arm and configured to attach to the flange of at least one of the end panels or side panels.

In some non-limiting embodiments, the main arm of each cable arm is spaced apart from an outer face of the corresponding end panel or side panel to define a gap for receiving a liner.

In some non-limiting embodiments, the fluid storage tank further includes at least one lower tension member having a first end connected to one of the end panels or side panels and a second end connected to another of the end panels or side panels.

In some non-limiting embodiments, each of the end panels and side panels includes a plate and two vertical flanges on opposite edges of the plate. The vertical flanges of each end panel and side panel define a plurality of connecting holes for receiving panel fasteners to removably attach each end panel or side panel to adjacent end panels and side panels. The plurality of connecting holes on the vertical flanges of each of the end panels and side panels are arranged in the same pattern so that each end panel and side panel may be connected to any other end panel or side panel.

In some non-limiting embodiments, each of the vertical flanges of the side panels defines a cable arm mounting hole, and each cable arm defines a panel mounting hole connectable to a cable arm mounting hole defined in each of a pair of adjacent panels consisting of at least one side panel and at least one end panel.

In some non-limiting embodiments, the cable arm mounting holes are one or more of the connecting holes.

In some non-limiting embodiments, each of the end panels and side panels further includes one or more ribs extending between the vertical flanges.

In some non-limiting embodiments, the perimeter wall is obround- or stadium-shaped.

In some non-limiting embodiments, the fluid storage tank further includes one or more external braces, each external brace extending from a corresponding one of the end panels or side panels. Each external brace includes a foot extending substantially perpendicular to the corresponding end panel or side panel, and a main leg extending from an end of the foot upward on an incline to attach to the corresponding end panel or side panel.

Other embodiments of the present invention are directed to a fluid storage tank system including a fluid storage tank including a plurality of end panels defining a first plurality of curved wall sections, a plurality of side panels extending between and connecting the first plurality of curved wall sections, the plurality of end panels and plurality of side panels defining a first perimeter wall, a plurality of cable arms, each connected to an outer face of at least one of the plurality of end panels and the plurality of side panels, and at least one upper tension member having a first end connected to one of the plurality of cable arms and a second end connected to another of the plurality of cable arms. The fluid storage tank system further includes a secondary containment tank including a plurality of end panels defining a second plurality of curved wall sections, and a plurality of side panels extending between and connecting the second plurality of curved wall sections. The plurality of end panels and plurality of side panels define a second perimeter wall concentrically or eccentrically surrounding the fluid storage tank.

In some non-limiting embodiments, the secondary containment tank further includes a plurality of cable arms, each connected to an outer face of one of the plurality of side panels, and at least one upper tension member having a first end connected to one of the plurality of cable arms and a second end connected to another of the plurality of cable arms.

In some non-limiting embodiments, each cable arm includes a main arm, at least one tension member mounting bracket attached to one end of the main arm and configured to attach to one of the upper tension members, and a panel mounting bracket attached to an opposite end of the main arm and configured to attach to the flange of at least one of the end panels or side panels.

In some non-limiting embodiments, the main arm of each cable arm is spaced apart from an outer face of the corresponding end panel or side panel to define a gap for receiving a liner.

In some non-limiting embodiments, the fluid storage tank further includes at least one lower tension member having a first end connected to one of the end panels or side panels and a second end connected to another of the end panels or side panels.

In some non-limiting embodiments, the first perimeter wall and the second perimeter wall are each obround- or stadium-shaped.

In some non-limiting embodiments, the plurality of end panels of the secondary containment tank have a larger radius than the plurality of end panels of the fluid storage tank.

Other embodiments of the present invention are directed to a method of assembling a fluid tank. The method includes arranging a plurality of end panels to define a plurality of curved wall sections, arranging a plurality of side panels extending between and connecting the plurality of curved wall sections to define a perimeter wall along with the curved wall sections, attaching a plurality of cable arms to at least one of the plurality of end panels and the plurality of side panels, attaching a first end of at least one upper tension member to a first of the plurality of cable arms, and attaching a second end of the at least one upper tension member to a second of the plurality of cable arms. The second of the plurality of cable arms is attached to a different side panel than the first of the plurality of cable arms.

In some non-limiting embodiments, the plurality of cable arms are attached to the plurality of end panels or the plurality of side panels such that a gap is defined between each cable arm and a corresponding one of the side panels.

In some non-limiting embodiments, the method further includes installing a liner over the perimeter wall such that a portion of the liner occupies the gap between each cable arm and the corresponding one of the end panels or side panels.

Further aspects and embodiments of the present invention are described in the following numbered clauses.

Clause 1. A fluid storage tank comprising: a plurality of end panels defining a plurality of curved wall sections; a plurality of side panels extending between and connecting the plurality of curved wall sections, the plurality of end panels and plurality of side panels defining a perimeter wall; a plurality of cable arms, each of the cable arms connected to a flange of at least one of the plurality of end panels or at least one of the plurality of side panels; and at least one upper tension member having a first end connected to one of the plurality of cable arms and a second end connected to another of the plurality of cable arms.

Clause 2. The fluid storage tank of clause 1, wherein each cable arm comprises: a main arm; at least one tension member mounting bracket attached to one end of the main arm and configured to attach to at least one of the upper tension members; and a panel mounting bracket attached to an opposite end of the main arm and configured to attach to the flange of at least one of the end panels or side panels.

Clause 3. The fluid storage tank of clause 1 or 2, wherein the main arm of each cable arm is spaced apart from an outer face of the corresponding end panel or side panel to define a gap for receiving a liner.

Clause 4. The fluid storage tank of any of clauses 1-3, further comprising at least one lower tension member having a first end connected to one of the end panels or side panels and a second end connected to another of the end panels or side panels.

Clause 5. The fluid storage tank of any of clauses 1-4, wherein each of the end panels and side panels comprises a plate and two vertical flanges on opposite edges of the plate, wherein the vertical flanges of each end panel and side panel define a plurality of connecting holes for receiving panel fasteners to removably attach each end panel or side panel to adjacent end panels and side panels, and wherein the plurality of connecting holes on the vertical flanges of each of the end panels and side panels are arranged in the same pattern so that each end panel and side panel may be connected to any other end panel or side panel.

Clause 6. The fluid storage tank of any of clauses 1-5, wherein each of the vertical flanges of the side panels defines a cable arm mounting hole, and wherein each cable arm defines a panel mounting hole connectable to a cable arm mounting hole defined in each of a pair of adjacent panels consisting of at least one side panel and at least one end panel.

Clause 7. The fluid storage tank of any of clauses 1-6, wherein the cable arm mounting holes are one or more of the connecting holes.

Clause 8. The fluid storage tank of any of clauses 1-7, wherein each of the end panels and side panels further comprises one or more ribs extending between the vertical flanges.

Clause 9. The fluid storage tank of any of clauses 1-8, wherein the perimeter wall is obround- or stadium-shaped.

Clause 10. The fluid storage tank of any of clauses 1-9, further comprising one or more external braces, each external brace extending from a corresponding one of the end panels or side panels, each external brace comprising: a foot extending substantially perpendicular to the corresponding end panel or side panel; and a main leg extending from an end of the foot upward on an incline to attach to the corresponding end panel or side panel.

Clause 11. A fluid storage tank system comprising: a fluid storage tank comprising: a plurality of end panels defining a first plurality of curved wall sections; a plurality of side panels extending between and connecting the first plurality of curved wall sections, the plurality of end panels and plurality of side panels defining a first perimeter wall; a plurality of cable arms, each connected to an outer face of at least one of the plurality of end panels and the plurality of side panels; and at least one upper tension member having a first end connected to one of the plurality of cable arms and a second end connected to another of the plurality of cable arms; and a secondary containment tank comprising: a plurality of end panels defining a second plurality of curved wall sections; and a plurality of side panels extending between and connecting the second plurality of curved wall sections, the plurality of end panels and plurality of side panels defining a second perimeter wall concentrically or eccentrically surrounding the fluid storage tank.

Clause 12. The fluid storage tank system of clause 11, wherein the secondary containment tank further comprises: a plurality of cable arms, each connected to an outer face of at least one of the plurality of end panels and the plurality of side panels; and at least one upper tension member having a first end connected to one of the plurality of cable arms and a second end connected to another of the plurality of cable arms.

Clause 13. The fluid storage tank system of clause 11 or 12, wherein each cable arm comprises: a main arm; at least one tension member mounting bracket attached to one end of the main arm and configured to attach to at least one of the upper tension members; and a panel mounting bracket attached to an opposite end of the main arm and configured to attach to the flange of at least one of the end panels or side panels.

Clause 14. The fluid storage tank system of any of clauses 11-13, wherein the main arm of each cable arm is spaced apart from an outer face of the corresponding end panel or side panel to define a gap for receiving a liner.

Clause 15. The fluid storage tank system of any of clauses 11-14, wherein the fluid storage tanks further comprises at least one lower tension member having a first end connected to one of the end panels or side panels and a second end connected to another of the end panels or side panels.

Clause 16. The fluid storage tank system of any of clauses 11-15, wherein the first perimeter wall and the second perimeter wall are each obround- or stadium-shaped.

Clause 17. The fluid storage tank system of any of clauses 11-16, wherein the plurality of end panels of the secondary containment tank have a larger radius than the plurality of end panels of the fluid storage tank.

Clause 18. A method of assembling a fluid tank, comprising: arranging a plurality of end panels to define a plurality of curved wall sections; arranging a plurality of side panels extending between and connecting the plurality of curved wall sections to define a perimeter wall along with the curved wall sections; attaching a plurality of cable arms to at least one of the plurality of end panels and the plurality of side panels; attaching a first end of at least one upper tension member to a first of the plurality of cable arms; and attaching a second end of the at least one upper tension member to a second of the plurality of cable arms, the second of the plurality of cable arms being attached to a different side panel than the first of the plurality of cable arms.

Clause 19. The method of clause 18, wherein the plurality of cable arms are attached to the plurality of end panels or the plurality of side panels such that a gap is defined between each cable arm and a corresponding one of the side panels.

Clause 20. The method of clause 18 or 19, further comprising: installing a liner over the perimeter wall such that a portion of the liner occupies the gap between each cable arm and the corresponding one of the end panels or side panels.

These and other features and characteristics of fluid storage tanks, as well as the methods of operation and assembly thereof, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the disclosure. As used in the specification and claims, the singular form of "a", "an", and "the" include plural referents unless the context clearly dictates otherwise.

DESCRIPTION OF THE INVENTION

For purposes of the description hereinafter, the terms "upper", "lower", "right", "left", "vertical", "horizontal", "top", "bottom", "lateral", "longitudinal", and derivatives thereof, shall relate to the disclosed apparatus as it is oriented in the figures. However, it is to be understood that the apparatus of the present disclosure may assume alternative variations and step sequences, except where expressly specified to the contrary. It is also to be understood that the specific systems and processes illustrated in the attached drawings, and described in the following specification, are simply exemplary examples of the apparatus disclosed herein. Hence, specific dimensions and other physical characteristics related to the examples disclosed herein are not to be considered as limiting.

As used herein, the term "at least one of" is synonymous with "one or more of". For example, the phrase "at least one of A, B, and C" means any one of A, B, and C, or any combination of any two or more of A, B, and C. For example, "at least one of A, B, and C" includes one or more of A alone; or one or more B alone; or one or more of C alone; or one or more of A and one or more of B; or one or more of A and one or more of C; or one or more of B and one or more of C; or one or more of all of A, B, and C. Similarly, as used herein, the term "at least two of" is synonymous with "two or more of". For example, the phrase "at least two of D, E, and F" means any combination of any two or more of D, E, and F. For example, "at least two of D, E, and F" includes one or more of D and one or more of E; or one or more of D and one or more of F; or one or more of E and one or more of F; or one or more of all of D, E, and F.

Figure 1:
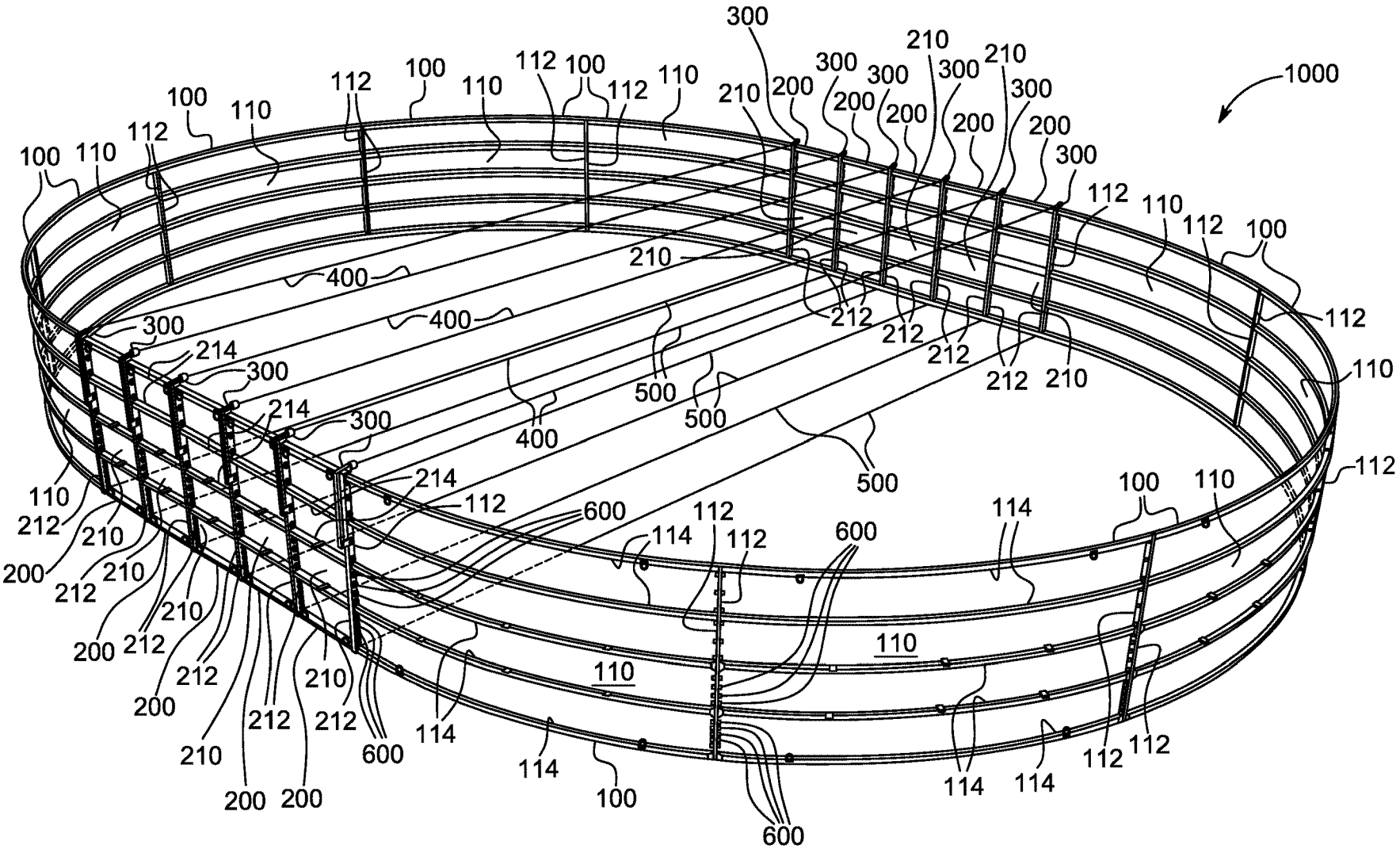
FIG. 1 is a perspective view of a fluid storage tank in accordance with an embodiment of the present invention.
Figure 2:
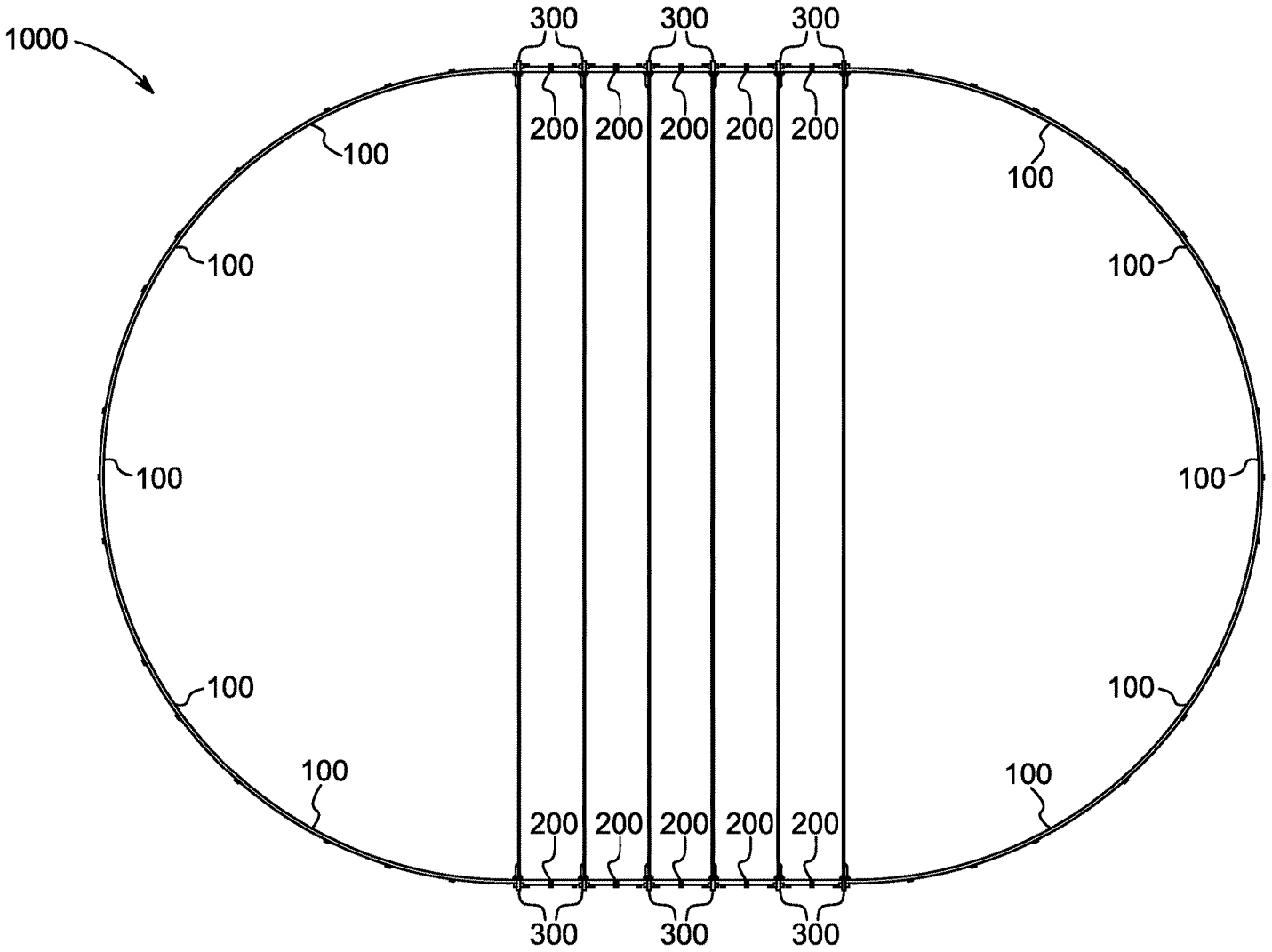
FIG. 2 is a top view of the fluid storage tank of FIG. 1.
Figure 3:
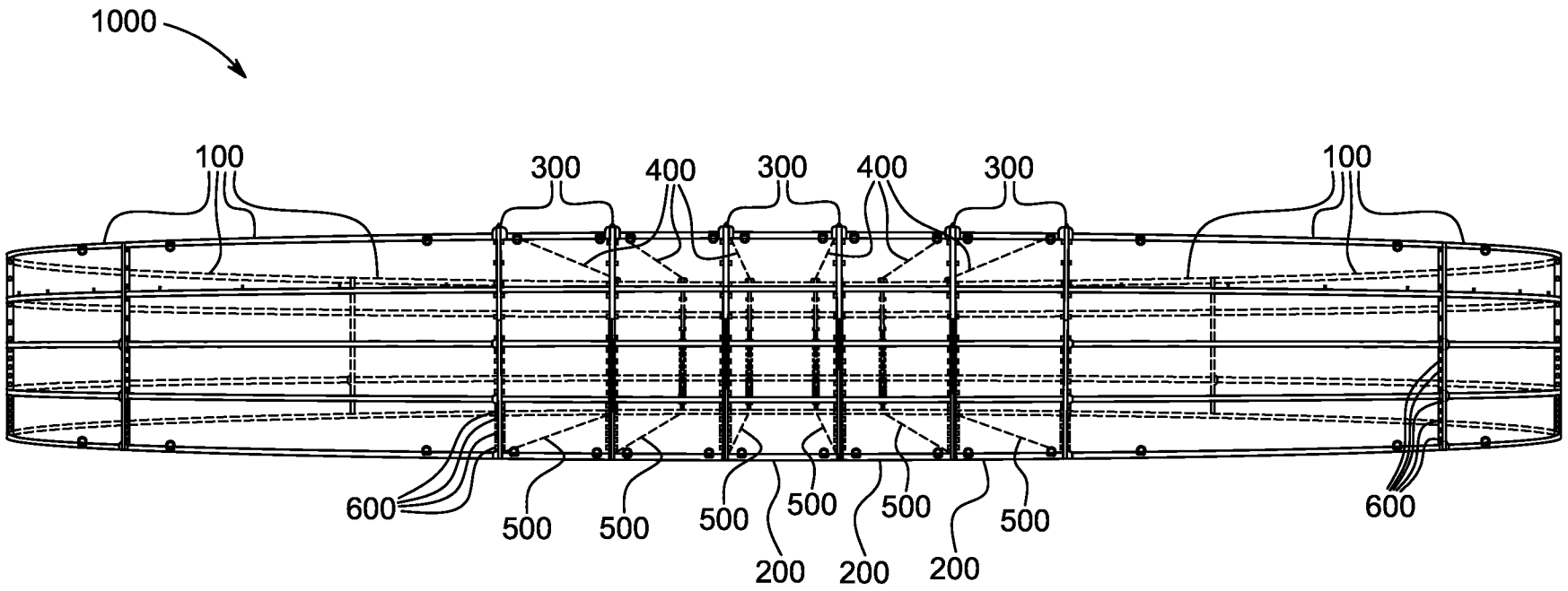
FIG. 3 is a side view of the fluid storage tank of FIG. 1.

Referring to FIGS. 1-3, a fluid storage tank 1000 according to embodiments of the present invention includes a plurality of end panels 100 and side panels 200 interconnected to one another to define a perimeter wall of the fluid storage tank 1000. In the embodiment shown in FIGS. 1-3, the fluid storage tank 1000 defines a stadium- or obround-shaped perimeter wall including two straight wall sections interposed between two curved, semicircular wall sections. Each of the semicircular wall sections may be formed of one or more curved end panels 100 defining a combined arc of approximately 180°. The two straight wall sections, each formed of one or more side panels 200, may be arranged substantially parallel to one another and connecting to the ends of the curved wall sections. Each of the end panels 100 and side panels 200 may be connected to adjacent end panels 100 and/or side panels 200 via panel fasteners 600, which may include bolts, screws, rivets, pins, clips, or other suitable removable or permanent fastening elements. FIGS. 1-3 show each semicircular wall section including five end panels 100 and each straight wall section including five side panels 200. However, it will be appreciated by those skilled in the art that any number of end panels 100 and side panels 200 may be used to construct the fluid storage tank 1000. Furthermore, shapes of the fluid storage tank 1000 other than the stadium or obround shape shown in the drawings may be appreciated by those skilled in the art. In particular, any shape having one or more arcuate sections and any number (including zero) of straight sections may be constructed according to the principles of the present invention.

While not shown in the drawings, a fluid impermeable liner may be installed in the fluid storage tank 1000 to retain stored fluid within an internal volume defined by the end panels 100, the side panels 200, and a ground surface on which the storage tank 1000 is positioned. More particularly, the liner may cover the ground surface bounded by the end panels 100 and side panels 200, extend up inside faces of the end panels 100 and side panels 200, fold over the tops of the end panels 100 and side panels 200, and drape at least partially down outside faces of the end panels 100 and side panels 200. The liner may then be secured to the end panels 100 and/or side panels 200 via straps, hooks, or other fastening devices to prevent shifting of the liner during use of the fluid storage tank 1000. The liner creates a fluid-proof barrier preventing fluid from escaping the fluid storage tank 1000, particularly at the joints between the end panels 100 and side panels 200.

With continued reference to FIGS. 1-3, one or more upper tension members 400 and/or one or more lower tension members 500 may span across the fluid storage tank 1000 connecting one end panel 100 or one side panel 200 to another end panel 100 or another side panel 200. Note that the lower tension members 500 are not shown in FIG. 2 as they are obstructed from view by the upper tension members 400. The upper tension members 400 and lower tension members 500 may be wire rope, cable, chain, or straps made from any suitable material to support a tension load imparted to the tension members 400, 500 by the hydrostatic pressure of fluid acting against the end panels 100 and side panels 200. The lower tension members 500 may be attached to attachment points on the base of the end panels 100 and/or side panels 200 prior to installation of the liner, such that the liner rests on top of the lower tension members 500. The upper tension members 400 are attached to the end panels 100 and/or side panels 200 via upper cable arms 300 extending from the outer faces of the end panels 100 and/or side panels 200 toward the tops of the end panels 100 and/or side panels 200, such that the upper cable arms 300 overlap the liner. This arrangement allows the upper tension members 400 to span the fluid storage tank 1000 without interfering with or requiring breaks in the liner. The upper cable arms 300 and connection thereof are explained in greater detail below with reference to FIGS. 5 and 6.

Figure 4:
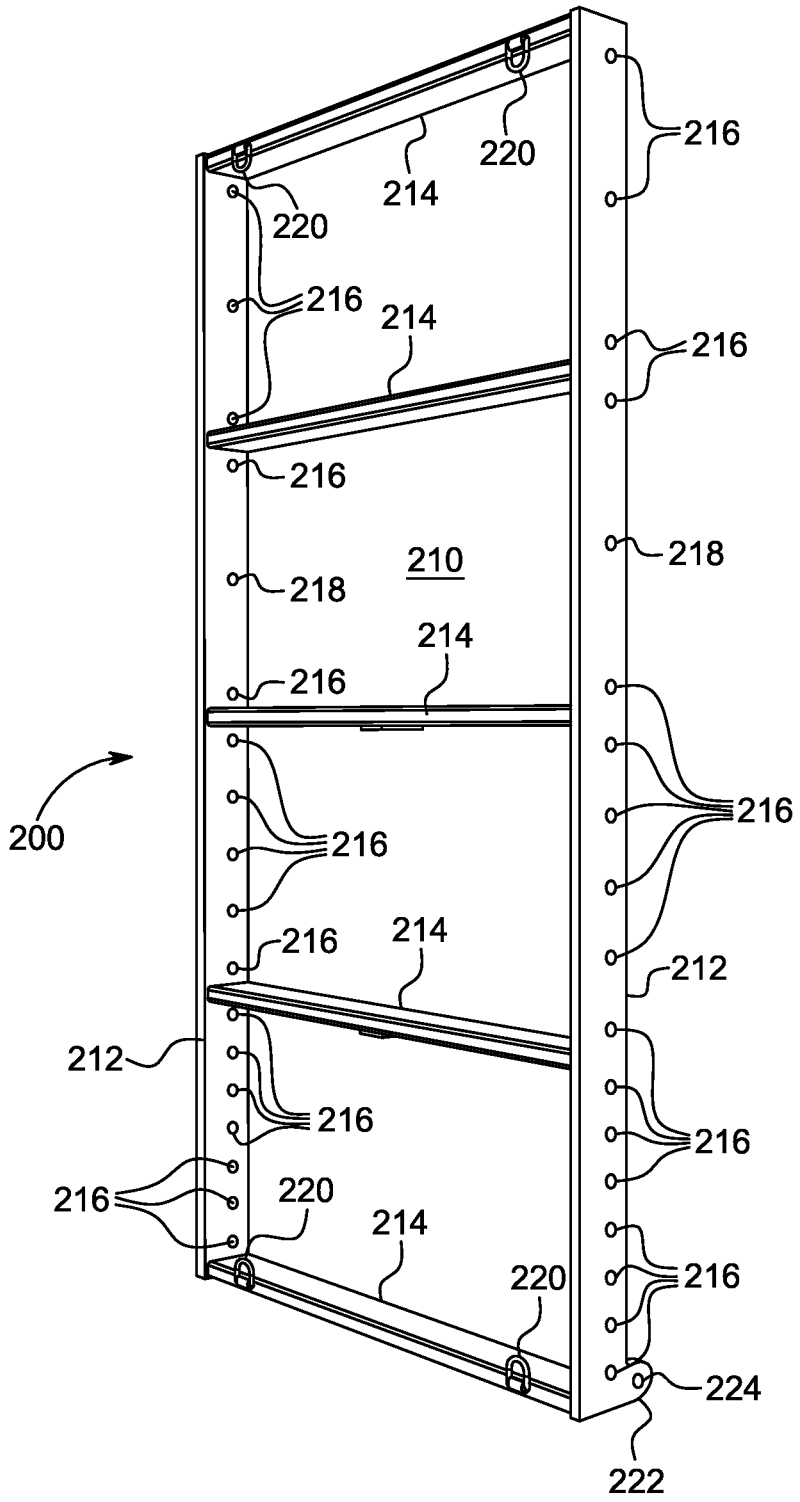
FIG. 4 is a perspective view of a side panel of the fluid storage tank of FIG. 1.

Referring now to FIG. 4, each side panel 200 of the fluid storage tank 1000 includes a plate 210 and two flanges 212 extending vertically along opposite edges of the plate 210. One or more ribs 214 extend between the flanges 212 to structurally reinforce the plate 210. Each flange 212 includes a plurality of panel connecting holes 216 for attaching the side panel 200 to an adjacent side panel 200 or end panel 100. Each flange 212 may further include at least one cable arm mounting hole 218, which may be one of the panel connecting holes 216, for attaching one of the plurality of upper cable arms 300 (see FIGS. 5-6). Specifically, the cable arm mounting hole 218 of the one flange 212 of one side panel 200 may be aligned with the cable arm mounting hole 218 of one vertical flange 212 of an adjacent side panel 200. One or more mounting tabs 222, each having a tension member mounting hole 224, may extend from the one of the flanges 212 and/or ribs 214 for attachment of the lower tension member 500 (see FIGS. 1 and 6) to the side panel 200. A lower tension member connector (not shown), such as a shackle, D-ring, connecting link, or the like, may attach the lower tension member 500 to the tension member mounting hole 224. Each side panel 200 may further include one or more lifting lugs 220 for lifting the side panel 200 using a crane or other equipment during assembly/disassembly of the fluid storage tank 1000.

Referring again to FIGS. 1-3, each end panel 100 includes substantially the same components as each side panel 200, except that the plate 110 and the ribs 114 of each end panel 100 are curved about a vertical axis. Each end panel 100 includes two flanges 112 extending vertically along opposite edges of the plate 110, with each flange 112 including a plurality of panel connecting holes 116 (not shown) arranged in the same pattern as the panel connecting holes 216 of the side panel 200. As such, the end panels 100 and side panels 200 may be connected to one another. Like the side panels 200, each end panel 100 may further include one or more lifting lugs 120 for lifting the end panel 100 using a crane or other equipment during assembly/disassembly of the fluid storage tank 1000.

The end panels 100 and side panels 200 may be connected to one another by arranging adjacent end panels 100 and/or side panels 200, such that their respective panel connecting holes 116, 216 align. The panel fasteners 600 may be inserted and secured through the connecting holes 116, 216 of the adjacent end panels 100 and/or side panels 200. To assist in assembly of the fluid storage tank 1000, the flanges 112, 212 of end panels 100 and side panels 200 may include alignment tabs or other features to guide the end panels 100 and side panels 200 into position relative to one another. One skilled in the art may appreciate that the end panels 100 and side panels 200 may be connected using arrangements other than the panel connecting holes of the flanges 112, 212. For example, adjacent end panels 100 and side panels 200 may be attached with clips or, in permanent installations, welds.

Figure 5:
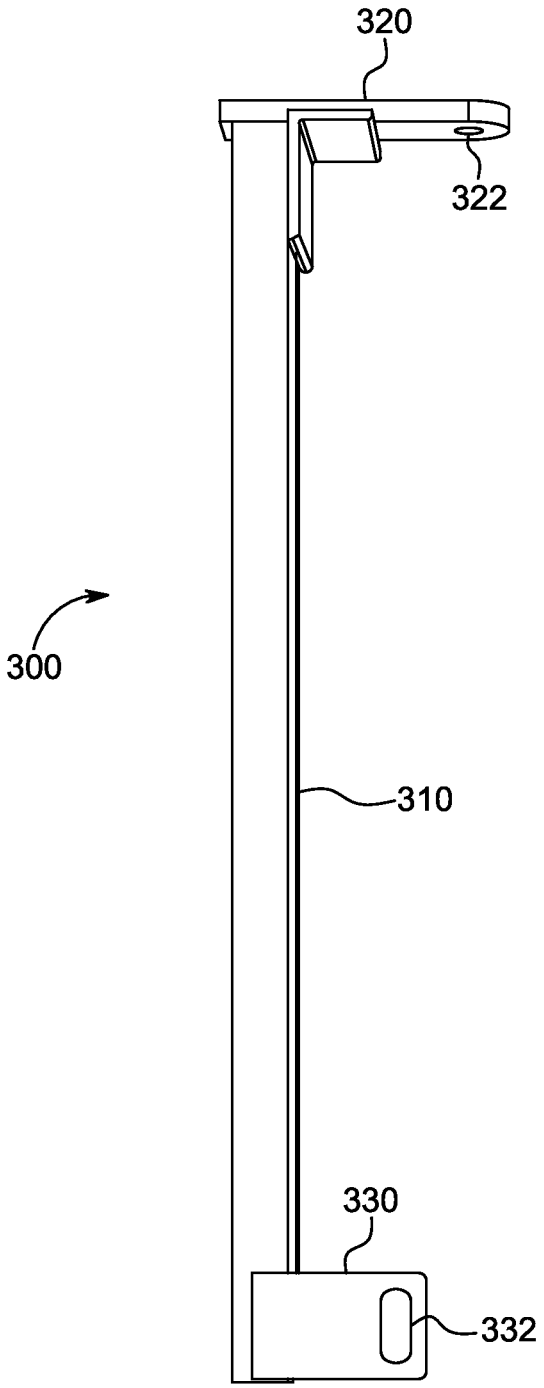
FIG. 5 is a side perspective view of an upper cable arm of the fluid storage tank of FIG. 1.
Figure 6:
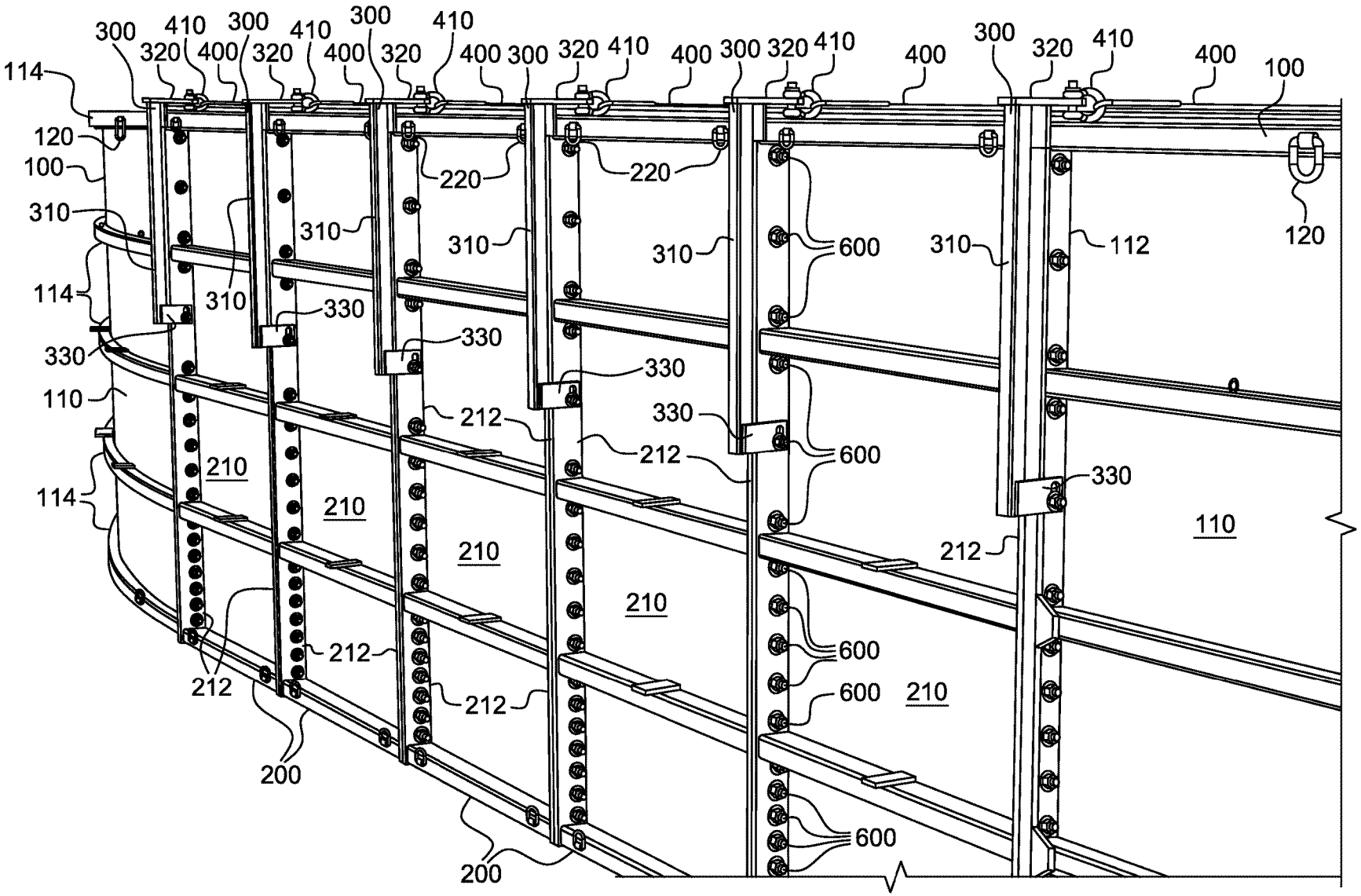
FIG. 6 is a perspective view of the fluid storage tank of FIG. 1 showing attachment of the upper cable arms thereof.

Referring now to FIG. 5-6, each upper cable arm 300 includes a main arm 310 having a primary tension member mounting bracket 320 at a first end and at least one panel mounting bracket 330 at an opposite end. The primary tension member mounting bracket 320 extends above the end panels 100 and side panels 200 and towards the center of the fluid storage tank 1000 when the fluid storage tank 1000 is assembled. The primary tension member mounting bracket 320 includes a tension member mounting hole 322 for connection to at least one of the upper tension members 400. As shown in FIG. 6, an upper tension member connector 410, such as a shackle or connecting link, may connect the corresponding upper tension member 400 to the tension member mounting hole 322.

With continued reference to FIG. 5, each upper cable arm 300 may further include a secondary tension member mounting bracket 324 extending from the main arm 310 in an opposite direction relative to the primary tension member mounting bracket 320. The secondary tension member mounting bracket 324 includes a tension member mounting hole 326 for connection to at least one tension member. In particular, the tension member mounting hole 326 of the secondary tension member mounting bracket 324 may be connected to a tension member extending between the upper cable arm 300 attached to the fluid storage tank 1000 and a second upper cable arm 300 attached to a secondary containment tank 2000 (see FIG. 7).

With continued reference to FIGS. 5 and 6, each of the at least one panel mounting brackets 330 includes a panel mounting hole 332 for connection to at least one of the end panels 100 or side panels 200 or a combination of at least one end panel 100 and at least one side panel 200. The panel mounting hole 332 may be aligned with the cable arm mounting holes 218 of a pair of adjacently arranged end panels 100 and/or side panels 200 and secured thereto via a panel fastener 600. In particular, the abutting flanges 112, 212 of a pair of adjacent end panels 100 and or side panels 200 may be arranged between the panel mounting brackets 330 of the upper cable arm 300, and the panel fastener 600 may be inserted through the cable arm mounting holes 218 and the panel mounting holes 332. As noted above, the cable arm mounting holes 218 may be one or more of the connecting holes 116, 216. The panel mounting hole 332 may be elongated in the form of a slot to allow for vertical adjustment of the upper cable arm 300 relative to the connected end panel 100 or side panel 200. The panel mounting bracket 330 may extend substantially perpendicular from the main arm 310 such that, as shown in FIG. 6, a gap is formed between the main arm 310 and an outer face of the corresponding end panel 100 or side panel 200 when the upper cable arm 300 is attached to the end panel 100 or side panel 200. The liner may occupy the gap between the main arm 310 and the corresponding end panel 100 or side panel 200, so that the upper cable arm 300 and the attached upper tension member 400 do not interfere with the liner being draped over the top of the storage tank 1000.

Figure 7:
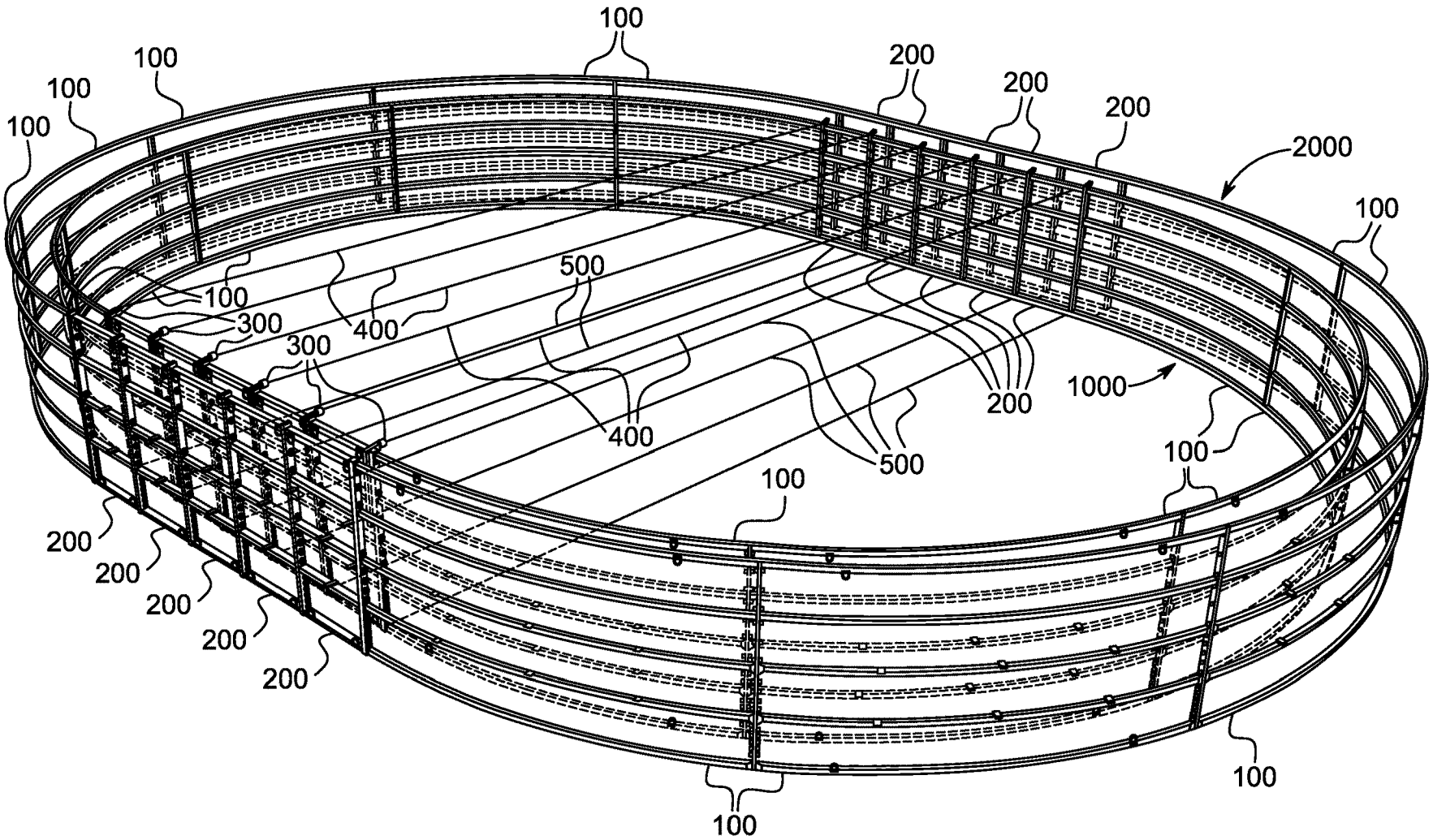
FIG. 7 is a perspective view of a fluid storage tank in accordance with another embodiment of the present invention.

Referring now to FIG. 7, a secondary containment tank 2000 may be arranged concentrically or eccentrically surrounding the fluid storage tank 1000 to contain overflow or spillage from the fluid storage tank 1000. The secondary containment tank 2000 may be constructed of interconnected end panels 100 and side panels 200, in substantially the same manner as the fluid storage tank 1000. The end panels 100 of the secondary containment tank 2000 may have a larger radius of curvature than the end panels 100 of the fluid storage tank 1000, so that the secondary containment tank 2000 defines a larger perimeter than the fluid storage tank 1000. Though not shown for clarity, the secondary containment tank 2000 may include upper tension members 400, lower tension members 500, and upper cable arms 300 in similar arrangement to that of the fluid storage tank 1000. As described above with reference to FIG. 5, a supplemental tension member (not shown, but similar to the upper tension members 400) may be utilized to connect an upper cable arm 300 of the fluid storage tank 1000 to an upper cable arm 300 of the secondary storage tank 2000. Particularly, a first end of the supplemental tension member may be connected to the tension member mounting hole 326 of the secondary tension member mounting bracket 324 of the upper cable arm 300 of the fluid storage tank 1000, and a second end of the supplemental tension member may be connected to the tension member mounting hole 322 of the primary tension member mounting bracket 320 of the upper cable arm 300 of the secondary containment tank 2000.

Figure 8:
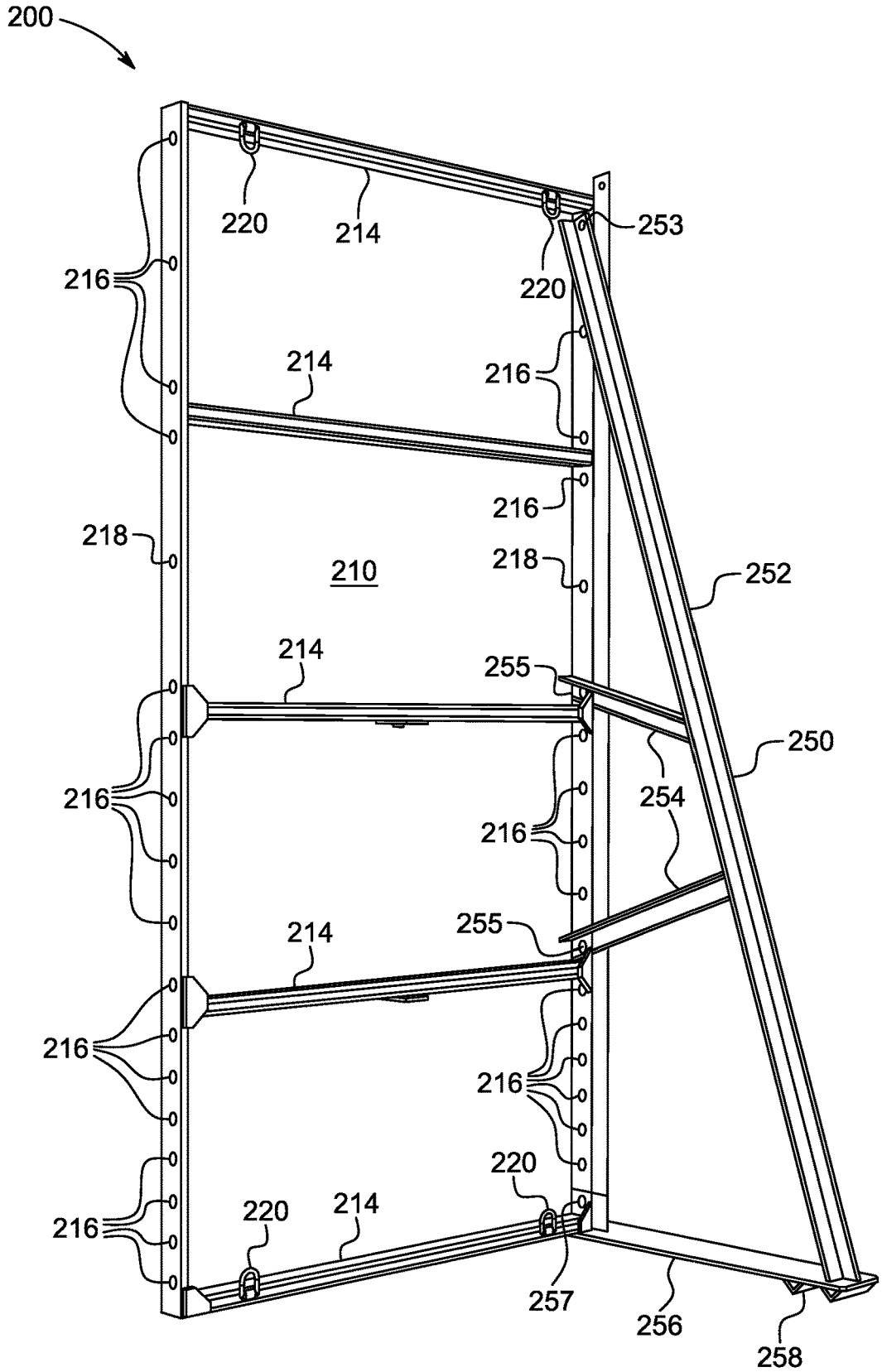
FIG. 8 is a perspective view of a side panel and external brace of a fluid storage tank in accordance with another embodiment of the present invention.

Referring now to FIG. 8, some embodiments of the fluid storage tank 1000 and/or secondary containment tank 2000 may include external braces 250 attached the side panels 200 to provide resistance to hydrostatic pressure of the stored fluid. The external braces 250 may be used in addition to or as an alternative to the upper tension members 400 and the lower tension members 500. Each external brace 250 includes a foot 256 extending substantially perpendicular from the base of the side panel 200. The foot 256 includes a mounting hole 257 which aligns with one of the panel connecting holes 216 of the side panel 200, such that the foot 256 may be secured to the side panel 200 when the corresponding panel fastener 600 is installed. The foot 256 may also include an anchor 258 for engaging the ground surface. A main leg 252 may extend from an end of the foot 256 opposite the mounting hole 257 upwards at an incline toward the side panel 200. The main leg 252 includes a mounting hole 253 which aligns with one or more of the panel connecting holes 216 of the side panel 200, such that the main leg 252 may be secured to the side panel 200 when the corresponding panel fasteners 600 are installed. One or more struts 254 may extend from the main leg 252 to the side panel 200 to provide additional bracing to the external brace. Each strut 254 includes a mounting hole 255 which aligns with one or more of the panel connecting holes 216 of the side panel 200, such that the strut 254 may be secured to the side panel 200 when the corresponding panel fasteners 600 are installed. The external brace 250 transmits hydrostatic pressure of the stored fluid through the main leg 252 into the ground to prevent bowing or failure of the side panel. The external brace 250 may also be attached to one of the end panels 100 using the panel connecting holes thereof.

While several examples of a fluid storage tank is shown in the accompanying figures and described in detail hereinabove, other examples will be apparent to, and readily made by, those skilled in the art without departing from the scope and spirit of the disclosure. For example, it is to be understood that aspects of the various embodiments described hereinabove may be combined with aspects of other embodiments while still falling within the scope of the present invention. Accordingly, the foregoing description is intended to be illustrative rather than restrictive. The assembly of the present invention described hereinabove is defined by the appended claims and all changes to the disclosed assembly that fall within the meaning and range of equivalency of the claims are to be embraced within their scope.

The invention claimed is:

1. A fluid storage tank comprising:

a plurality of end panels defining a plurality of curved wall sections;

a plurality of side panels extending between and connecting the plurality of curved wall sections, the plurality of end panels and plurality of side panels defining a perimeter wall;

a plurality of cable arms, each of the cable arms connected to a flange of at least one of the plurality of end panels or at least one of the plurality of side panels; and at least one upper tension member having a first end connected to one of the plurality of cable arms and a second end connected to another of the plurality of cable arms, wherein the at least one upper tension member extends across an internal volume of the fluid storage tank along a plane above the plurality of side panels.

2. The fluid storage tank of claim 1, wherein each cable arm comprises:

a main arm;

at least one tension member mounting bracket attached to one end of the main arm and configured to attach to at least one of the upper tension members; and a panel mounting bracket attached to an opposite end of the main arm and configured to attach to the flange of at least one of the end panels or side panels.

3. The fluid storage tank of claim 2, wherein the main arm of each cable arm is spaced apart from an outer face of the corresponding end panel or side panel to define a gap for receiving a liner.

4. The fluid storage tank of claim 1, further comprising at least one lower tension member having a first end connected to one of the end panels or side panels and a second end connected to another of the end panels or side panels.

5. The fluid storage tank of claim 1, wherein each of the end panels and side panels comprises a plate and two vertical flanges on opposite edges of the plate, wherein the vertical flanges of each end panel and side panel define a plurality of connecting holes for receiving panel fasteners to removably attach each end panel or side panel to adjacent end panels and side panels, and wherein the plurality of connecting holes on the vertical flanges of each of the end panels and side panels are arranged in the same pattern so that each end panel and side panel may be connected to any other end panel or side panel.

6. The fluid storage tank of claim 5, wherein each of the vertical flanges of the side panels defines a cable arm mounting hole, and wherein each cable arm defines a panel mounting hole connectable to a cable arm mounting hole defined in each of a pair of adjacent panels consisting of at least one side panel and at least one end panel.

7. The fluid storage tank of claim 6, wherein the cable arm mounting holes are one or more of the connecting holes.

8. The fluid storage tank of claim 5, wherein each of the end panels and side panels further comprises one or more ribs extending between the vertical flanges.

9. The fluid storage tank of claim 1, wherein the perimeter wall is obround-shaped.

10. The fluid storage tank of claim 1, further comprising one or more external braces, each external brace extending from a corresponding one of the end panels or side panels, each external brace comprising:

a foot extending substantially perpendicular to the corresponding end panel or side panel; and a main leg extending from an end of the foot upward on an incline to attach to the corresponding end panel or side panel.

11. A fluid storage tank system comprising:

a primary fluid storage tank comprising:

a plurality of end panels defining a first plurality of curved wall sections;

a plurality of side panels extending between and connecting the first plurality of curved wall sections, the plurality of end panels and plurality of side panels defining a first perimeter wall;

a plurality of cable arms, each connected to an outer face of at least one of the plurality of end panels and the plurality of side panels; and at least one upper tension member having a first end connected to one of the plurality of cable arms and a second end connected to another of the plurality of cable arms; and a secondary containment tank comprising:

a plurality of end panels defining a second plurality of curved wall sections; and a plurality of side panels extending between and connecting the second plurality of curved wall sections, the plurality of end panels and plurality of side panels defining a second perimeter wall concentrically or eccentrically surrounding the primary fluid storage tank wherein the first perimeter wall and the second perimeter wall are each obround-shape.

12. The fluid storage tank system of claim 11, wherein the secondary containment tank further comprises:

a plurality of cable arms, each connected to an outer face of at least one of the plurality of end panels and the plurality of side panels; and at least one upper tension member having a first end connected to one of the plurality of cable arms and a second end connected to another of the plurality of cable arms.

13. The fluid storage tank system of claim 11, wherein each cable arm comprises:

a main arm;

at least one tension member mounting bracket attached to one end of the main arm and configured to attach to at least one of the upper tension members; and a panel mounting bracket attached to an opposite end of the main arm and configured to attach to the flange of at least one of the end panels or side panels.

14. The fluid storage tank system of claim 13, wherein the main arm of each cable arm is spaced apart from an outer face of the corresponding end panel or side panel to define a gap for receiving a liner.

15. The fluid storage tank system of claim 11, wherein the primary and secondary fluid storage tanks further comprise at least one lower tension member having a first end connected to one of the end panels or side panels and a second end connected to another of the end panels or side panels.

16. The fluid storage tank system of claim 11, wherein the plurality of end panels of the secondary containment tank have a larger radius than the plurality of end panels of the primary fluid storage tank.

17. A method of assembling a fluid tank, comprising:

arranging a plurality of end panels to define a plurality of curved wall sections;

arranging a plurality of side panels extending between and connecting the plurality of curved wall sections to define a perimeter wall along with the curved wall sections;

attaching a plurality of cable arms to at least one of the plurality of end panels and the plurality of side panels;

attaching a first end of at least one upper tension member to a first of the plurality of cable arms; and attaching a second end of the at least one upper tension member to a second of the plurality of cable arms such that the at least one upper tension member extends across an internal volume of the fluid tank along a plane above the plurality of side panels, the second of the plurality of cable arms being attached to a different side panel than the first of the plurality of cable arms.

18. The method of claim 17, wherein the plurality of cable arms are attached to the plurality of end panels or the plurality of side panels such that a gap is defined between each cable arm and a corresponding one of the side panels.

19. The method of claim 18, further comprising:

installing a liner over the perimeter wall such that a portion of the liner occupies the gap between each cable arm and the corresponding one of the end panels or side panels.

* * * * *